United States Patent [19]

Teleky

[11] Patent Number: 4,539,828

[45] Date of Patent: Sep. 10, 1985

[54] SECURITY LOCK BOX WITH REMOVABLE KEY PLUG

[76] Inventor: Walter Teleky, 7002 Boulevard East, Apt. 11B, Guttenberg, N.J. 07093

[21] Appl. No.: 361,963

[22] Filed: Mar. 25, 1982

Related U.S. Application Data

[63] Continuation-in-part of Ser. No. 199,337, Oct. 21, 1980, abandoned.

[51] Int. Cl.[3] ..... E05B 9/04

[52] U.S. Cl. ..... 70/369; 70/370; 70/371

[58] Field of Search ..... 70/63, 367, 369, 370, 70/371, 120, 82; 49/295, 383, 388

[56] References Cited

U.S. PATENT DOCUMENTS

| | | | |
|---|---|---|---|
| 924,331 | 6/1909 | Feola | 70/371 |
| 1,436,925 | 11/1922 | Wege et al. | 70/120 |
| 1,979,938 | 11/1934 | Jacobi | 70/369 |
| 1,982,813 | 12/1934 | Jacobi | 70/371 |
| 3,296,842 | 1/1967 | Auerbach et al. | 70/82 |
| 3,564,879 | 2/1971 | Bennett | 70/58 X |
| 3,843,173 | 10/1974 | Harrell | 70/82 X |
| 4,145,978 | 3/1979 | Johnson et al. | 109/59 R |
| 4,202,587 | 5/1980 | Wieland | 70/370 X |
| 4,272,975 | 6/1981 | Patriquin | 70/371 X |
| 4,328,690 | 5/1982 | Oliver | 70/369 |
| 4,398,405 | 8/1983 | Patriquin | 70/369 |

FOREIGN PATENT DOCUMENTS

| | | | |
|---|---|---|---|
| 393791 | 4/1924 | Fed. Rep. of Germany | 70/120 |
| 927444 | 8/1956 | Fed. Rep. of Germany | 292/336.5 |
| 1575650 | 6/1969 | France | 49/383 |

*Primary Examiner*—Gary L. Smith
*Assistant Examiner*—Lloyd A. Gall
*Attorney, Agent, or Firm*—Natter & Natter

[57] ABSTRACT

A security lock box includes a receptacle having an access opening and a hinged door. A vertical door edge adjacent th hinge is provided with an edge return which engages an inwardly curved lip along the receptacle opening for preventing entry through removal of a hinge pin. The door additionally has flanges extending transversely along top and bottom edges. The flanges are adapted for cooperative interfitting within confronting guard recesses along the margin of the receptacle opening. A locking mechanism having a pair of selectively slidably locking bars is positioned within the access opening. The locking bars are extendable through slots within the door flanges for securing the door in a locked mode. The locking mechanism is activated by a cylinder lock mounted in the door. The cylinder lock includes a cylindrical housing for accommodating a removable key plug and operating key adapted for interchangeable applications within a plurality of similar lock cylinders. The key plug includes a tail member for engaging the locking mechanism and is further provided with a keeper element for retaining the key plug within the cylinder housing when the door is in a locked mode.

15 Claims, 10 Drawing Figures

FIG. 5
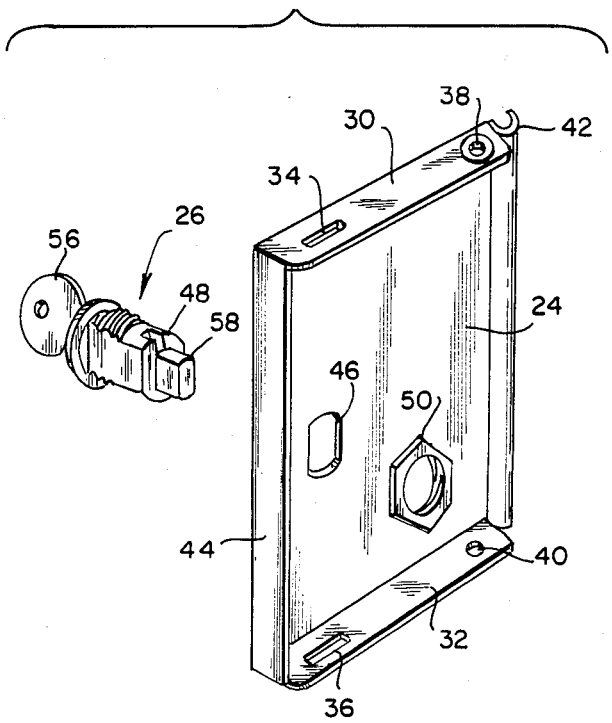
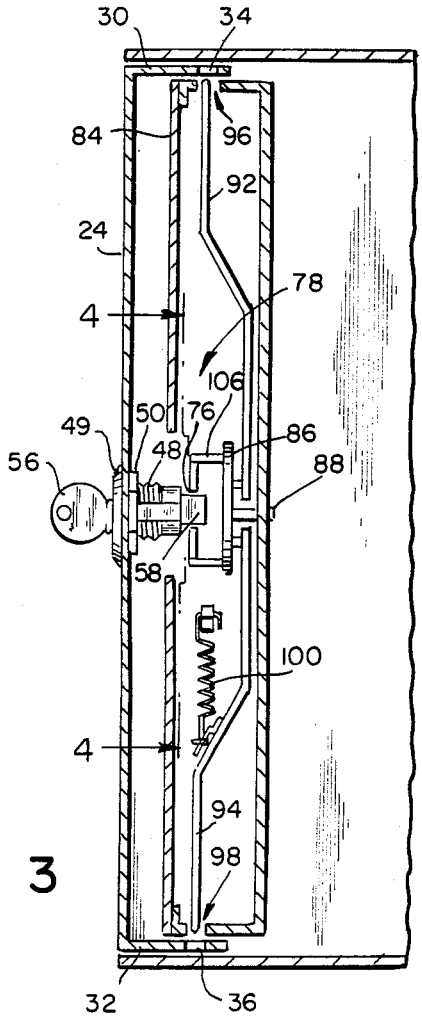
FIG. 3
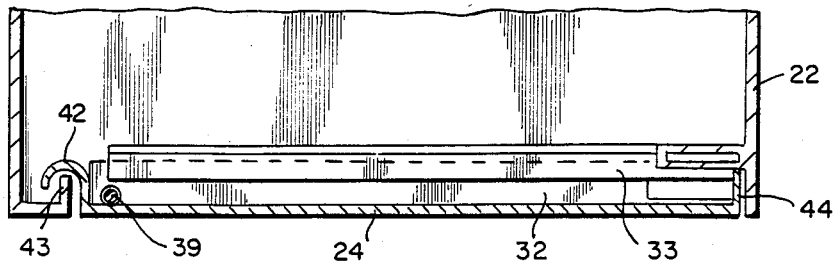
FIG. 6

SECURITY LOCK BOX WITH REMOVABLE KEY PLUG

CROSS REFERENCE TO RELATED APPLICATION

This is a continuation-in-part application of application Ser. No. 199,337 entitled SECURITY LOCK BOX, filed Oct. 21, 1980, now abandoned.

TECHNICAL FIELD

This invention relates generally to theft prevention devices and especially to a repository for the safekeeping of valuables and other personal property.

In particular, the device of this invention concerns a protective enclosure of tamper proof construction which is accessible through the application of a removable lock component.

BACKGROUND ART

The increasing awareness of the necessity for safeguarding unattended personal property and valuables prompted the development of various security systems. This became a matter of particular concern with regard to innkeepers and the management of other establishments which sought to protect their guests' property. An approach that gained noteworthy acceptance involved the utilization of personal key operated in-room strong boxes. The integrity of those protective measures in maintaining effective access control was substantially impaired. A serious deficiency was that previous guests or hotel employees could duplicate keys for later unauthorized re-entry into the depositories.

In an attempt to overcome these shortcomings, wall safes were developed which contained a standardized removable door incorporating a lock cylinder such as those marketed under the trademark Telsafe and described in the pioneer U.S. Pat. Nos. 3,481,288 and 3,715,998. Other wall safe constructions with removable doors were disclosed in U.S. Pat. Nos. 4,145,978, 4,148,265, 4,158,377, 4,258,632 and 4,278,033.

In accordance with the Telsafe limited access security system, a newly registered guest received a randomly selected sealed packet containing a door having a lock cylinder and a key. The door could then be used for sealing a selected safe mounted within the guest's hotel room. Each door was compatible for use with any of the strong boxes provided in each of the guest rooms. This concept provided a theft deterrent, however there were still certain inherent disadvantages. It should be apparent, for example, that the removable door which was made of heavy gauge steel was thus subject to certain weight and size limitations. As a consequence, the dimensions of the strong box were correspondingly restricted. This had an adverse effect on the storage capacity and was a limiting factor as to what items of personal property could be stored therein. A distinct shortcoming therefore of those strong boxes was that larger size or bulky objects such as cameras, cassette players and C.B. radios could not be stored therein.

The earlier filed related application provided a solution to this problem—the strong box was provided with a hinged door and thus eliminated the size restraints. The several embodiments disclosed arrangements for securing a removable lock cylinder to the swingable door. The lock cylinders were interchangeable and could be randomly distributed to each new guest and adapted for the in-room wall safe.

The present invention introduces a still further improvement wherein a lock cylinder permanently affixed to a hinged door is provided with an interchangeable lock component. This is in full consonance with the security system concept heretofore described yet provides a more convenient and reliable agency for limited access control.

DISCLOSURE OF THE INVENTION

Briefly, the nature of this invention involves an individualized room depository for the accommodation of hotel guests or other lessees. A purpose of this device is to provide protection against unauthorized entry into a strongbox either by lock picking, key duplication or direct attack upon the receptacle.

In summary, the device of this invention concerns a receptacle forming a lock box which is adapted for bolted connection onto a fixed wall surface or other convenient location. The receptacle includes an access opening and hinged door having inturned flanges along a top and bottom margin. The hinged side of the door is provided with an edge return which is designed to interlock with a curved lip along the opening when the door is in a closed position. The flanges are received within confronting guard recesses. The remaining vertical side opposite the edge return has a transverse face and is accommodated within the receptacle opening for providing a relatively jimmy-resistant door.

A locking mechanism is incorporated within a housing mounted to a side wall of the receptacle opening. The locking mechanism includes a locking cam for operating a twin locking bar arrangement. The bars are extendable through aligned openings within the respective door flanges along the upper and lower edge of the door.

The gist of this improvement is directed to the utilization of a lock cylinder assembly mounted within the door which has a detachable key plug. The key plug and an operating key are adapted for interchangeable applications within a plurality of similar lock cylinder assemblies although companion keys can be required for each of the respective key plugs. The key plug further includes a tail for activating the locking cam.

An advantage of this invention is that the key plug can be readily inserted and removed from the cylinder housing for insuring smooth, efficient and reliable operation.

Another feature of this invention concerns the interrelationship between the removable key plug and cylinder housing whereby only the key and not the plug is removable when the door is in the locked mode.

Having thus summarized the invention, it will be seen that it is an object thereof to provide a security lock box of the general character described herein which is not subject to the aforementioned disadvantages.

Specifically, it is an object of this invention to provide a security lock box having a lock cylinder housing adapted for receiving an interchangeable key plug.

Still another object of this invention is to provide a security lock box having a removable key plug adapted for interconnection with a locking cam for operating an integral locking mechanism.

A still further object of this invention is to provide a security lock box having a key plug which can be withdrawn from the lock cylinder housing yet is permanently retained within the cylinder housing when the door is in a locked mode.

Still another object of this invention is to provide a security lock box of the general character described which is simple in construction, low in cost, reliable in use, and well adapted for mass production fabrication techniques.

Other objects, features and advantages of the invention in part will be obvious and in part will be pointed out hereinafter.

With these ends in view, the invention finds embodiment in certain combinations of elements and arrangements of parts by which the objects aforementioned and certain other objects are hereinafter attained, all as more fully described with reference to the accompanying drawings and the scope of which is more particularly pointed out and indicated in the appended claims.

BRIEF DESCRIPTION OF THE DRAWINGS

In the accompanying drawings in which is shown a possible exemplary embodiment of the invention:

FIG. 3 is a sectional view of the locking mechanism to an enlarged scale taken substantially along line 3—3 of FIG. 1 and shows a locking cam for displacing a twin lock bar through a pair of locking apertures within the door;

FIG. 5 is an isolated perspective view which shows, in exploded fashion, the securement of the cylinder lock to the door;

FIG. 6 is a sectional view to an enlarged scale taken substantially along line 6—6 of FIG. 1 and illustrates engagement of the door with a guard recess along the margin of the receptacle opening and further shows an edge return interlocked with an inturned curved lip of the receptacle wall;

BEST MODE FOR CARRYING OUT THE INVENTION

Figure 1:
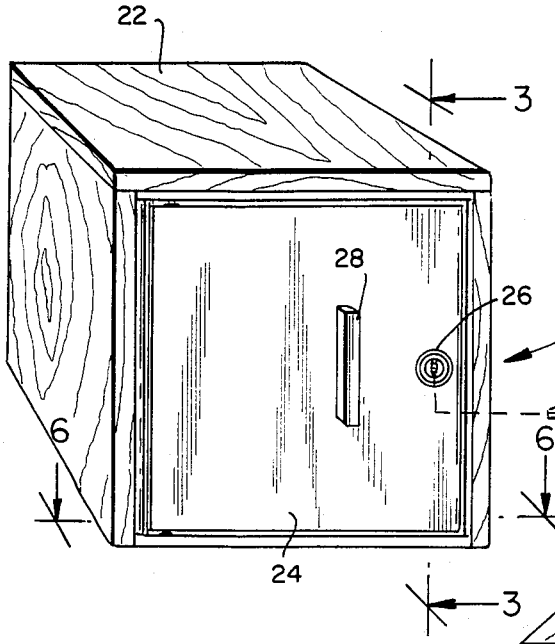
FIG. 1 is a perspective view of a security lock box in accordance with this invention and shows a receptacle with a door in a locked mode, together with a key as withdrawn from a cylinder lock mounted in the door.

Referring now in detail to the drawings, the reference numeral 20 denotes generally a security lock box of this invention. The lock box 20 is comprised of a container or receptacle 22 having a hingedly mounted door 24. It should be noted that the term lock box as used herein is also considered to generically encompass a strongbox, safe, personal vault or similar protective enclosure.

As particularly noted in FIGS. 1 and 5, the door 24 includes a cylinder lock 26 and handle 28. In order to facilitate installation by bolting box 20 to a wall or other surface, interior bolt holes (not shown) can be provided. In this exemplary embodiment the receptacle 22 and door 24 are fabricated of heavy gauge steel. By way of example, the lock box 20 typically has the following dimensions: height 33 cm. (13 inches), width 36 cm. (14 inches), depth 31 cm. (12 inches) with a door size of approximately 29 cm.×29 cm. (11½ inches×11½ inches). The approximate weight of this lock box is 20 kilograms (44 pounds). The preferred cylinder lock 26 is a modification of a commercially available lock sold under the trademark Medeco (catalog number 64-550). In addition, the receptacle 22 has been provided with wood grain laminated finish for compatibility with hotel room decor.

The door 24 is preferably fabricated of a single panel having a flange 30, 32 along respective upper and lower panel edges. The flange 30, 32 lies substantially normal to the plane of the door 24 and is further provided with a respective locking slot 34, 36 and a respective hinge pin aperture 38, 40. The vertical edge of the door 24 adjacent to the hinge pin aperture 38, 40 includes a curved extension or edge return 42 coextensive with the edge of the door 24. The distal vertical door edge is defined by a transverse face 44. The door 24 is further provided with aperture 46 for receiving the cylinder lock 26. A hinge pin 39 is used for pivotally mounting the door 24 to the receptacle 22. In the embodiment illustrated the hinge pin 39 extends through each of the respective hinge pin apertures 38, 40 and terminates within the respective upper and lower walls of receptacle 22. As previously noted, the edge return 42 engages an inwardly curved lip 43 when in a closed position as shown in FIG. 6. In this connection it should be observed that, even if the hinge pin 39 should be removed, the door 24 will still be secure against forceable entry. When the door 24 is opened (as shown in FIG. 2), the edge return 42 clears the inturned lip 43 which does not present an obstacle to the swingable movement of the door 24.

Figure 2:
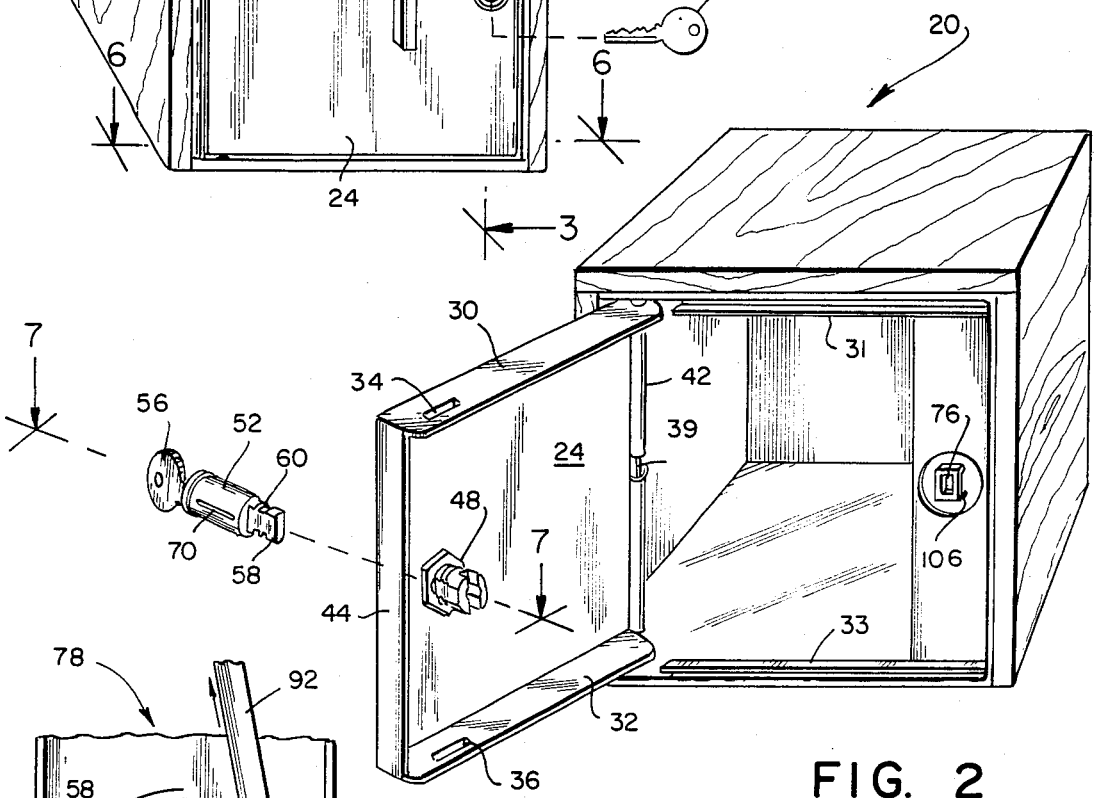
FIG. 2 is a perspective view of the security lock box and shows the door ajar and a lock cylinder housing with a key plug removed; a portion of a locking mechanism is also illustrated.

In regard to the securement of the top and bottom edges of door 24, reference is made to FIGS. 2 and 6 wherein it will be seen that the upper flange 30 and the lower flange 32 are received within respective guard recesses 31, 33. The transverse face 44 is also received interiorly of the receptacle 22. It should thus be apparent that the four peripheral edges of the door 24 are not readily accessible to a prying tool for opening the lock box 20.

Figure 9:
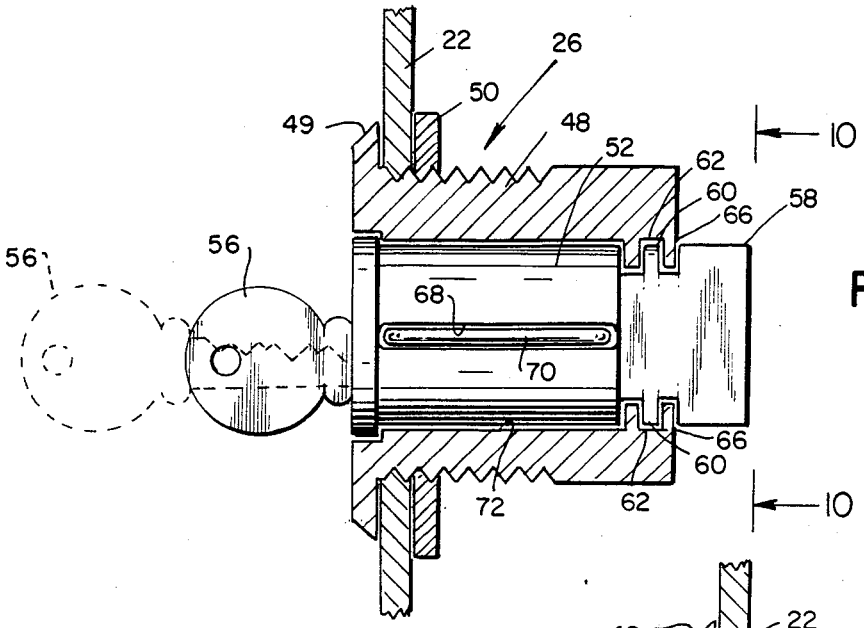
FIG. 9 is a sectional view to an enlarged scale which shows the key plug after rotation through a 90 degree displacement for activating the locking mechanism and withdrawal of the key (indicated in broken line)
Figure 10:
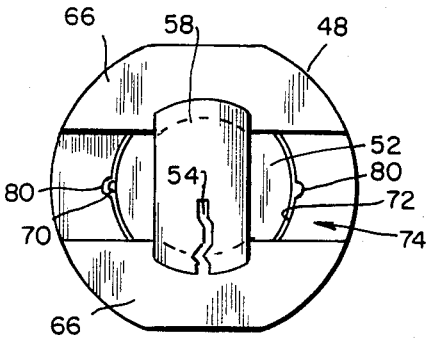
FIG. 10 is an auxiliary view taken along line 10—10 of FIG. 9 and shows the tail member secured behind a shoulder segment of the cylinder housing for preventing withdrawal of the key plug assembly when in the locked mode.

Referring once again to the cylinder lock 26, it should be observed with particular reference to FIGS. 5 and 9 that the assembly includes an outer shell or cylinder housing 48 having an integral bezel 49 and a threaded portion for receiving a hexagonal mounting nut 50. The cylindrical housing 48 includes a rotatable core or key plug 52. The key plug 52 contains a key receiving aperture 54 for accepting an operating key 56. In addition, the plug 52 is formed with a substantially cylindrical surface 57 which terminates in a rectangular lug or tail member 58. The tail member 58 has a set of fins 60 adapted for accommodation within a complementary series of grooves 62 positioned interiorly within the cylinder housing 48. When the fins 60 are engaged within the grooves 62, the key plug 52 cannot be removed. Additionally, the tail member 58 will be displaceable behind a pair of shoulder segments 66 at the distal end of the housing 48 to further prevent withdrawal of the key plug 52 when the door 24 is in a locked mode as shown in FIGS. 1, 9 and 10.

Directing attention now to the key plug 52, the cylindrical surface 57 includes a longitudinal slot 68 through which a spring urged retainer or keeper bar 70 can project. The keeper bar 70 can be depressed to a position substantially flush with the cylindrical surface 57 only when the key 56 is inserted into the key aperture 54. Furthermore, the key 56 cannot be withdrawn from the key plug 52 if the keeper bar 70 is depressed.

Figure 7:
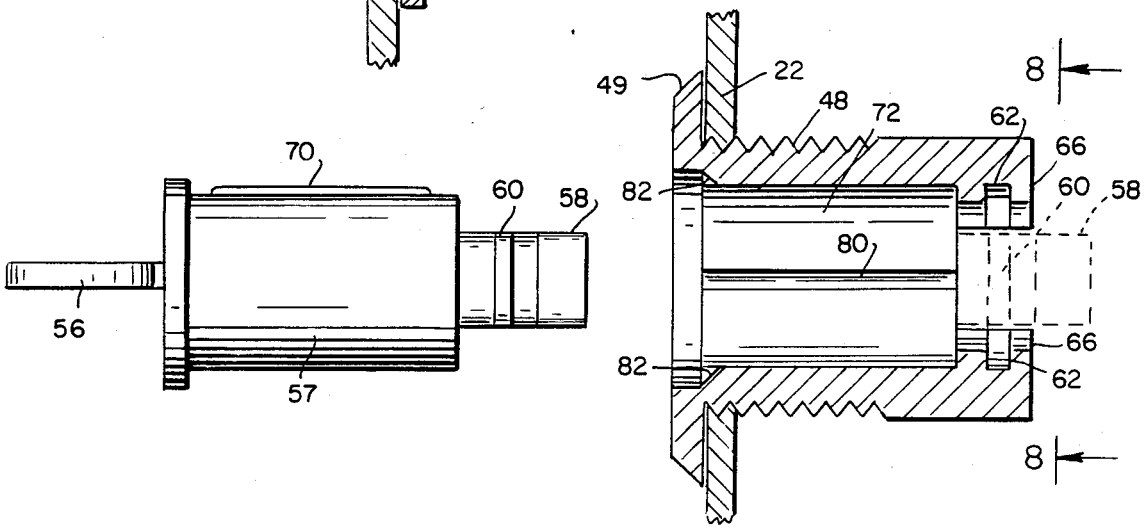
FIG. 7 is a sectional view to an enlarged scale taken substantially along line 7—7 of FIG. 2 and shows the interchangeable key plug with the key therein and the cylinder housing mounted in the door for receiving the key plug and key; the position of the tail member when inserted within the housing is shown in broken line.
Figure 8:
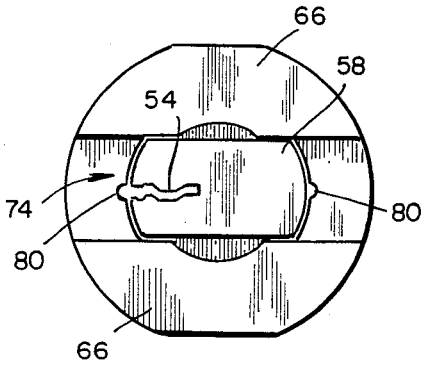
FIG. 8 is an auxiliary view taken substantially along line 8—8 of FIG. 7 and shows the orientation of the key plug positioned within the cylinder housing after insertion and prior to rotation into a locked mode.

The cylinder housing 48 includes a passageway 72 for slidingly accommodating the key plug 52 for longitudinal and rotational movement. In this connection it should be noted that the pair of shoulder segments 66 provide a substantially rectangular egress opening 74 for the tail member 58 which must be in alignment with the rectangular egress 74 for entry and withdrawal (see FIGS. 7 and 8). This alignment corresponds with a keyway 76 in a latching mechanism 78 as will be further described hereinafter and thus insures registration of the tail 58 within the keyway 76. The passageway 72 also has two longitudinal channels 80 for accepting the keeper bar 70 as it projects through the slot 68. The channels 80 are provided on opposite sides of the passageway 72 and placed such that when the tail 58 is in a locked position (FIGS. 9 and 10), the keeper bar 70 will be seated within the channel 80 and the key 56 can be withdrawn.

In order to guide entry of the key plug 52 within the passageway 72 a portal notch 82 is provided for engaging and depressing the keeper bar 70. As the key plug 52 is rotated into the locked position, the keeper bar 70 will be released and "snaps" into the channel 80 providing both an audible and mechanical indication that the tail member 58 has rotated into the locked mode. Since the tail member 58 will now engage the shoulder segments 66 as the fins 60 are simultaneously received within the grooves 62, the key 56 can be withdrawn and the plug 52 will remain within the housing 48 as the key 56 is withdrawn. In order to remove the key plug 52, the key 56 must be reinserted and the plug 52 rotated 90 degrees such that the tail member 58 is in alignment with the rectangular egress opening 74 of the cylinder housing 48 and the keeper bar 70 is depressed against the passageway 72. The key 56 cannot now be withdrawn from the key plug 52 and will thus permit removal with the key plug 52.

Figure 4:
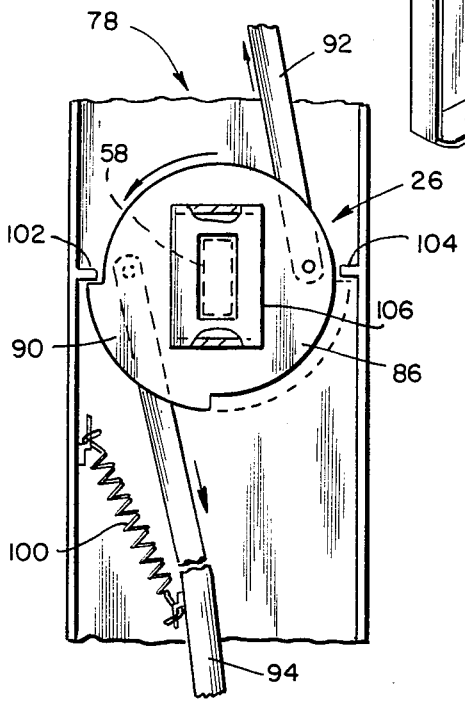
FIG. 4 is a partial auxiliary view of the locking mechanism taken substantially along line 4—4 of FIG. 3 and illustrates the operation of the locking cam which is selectively rotatable by a tail member extending from the key plug, the direction of movement of the respective parts being illustrated by the arrows.

The operation of the latching mechanism 78 will now be described with particular reference to FIGS. 3 and 4. As illustrated, the latching mechanism 78 is enclosed within a housing 84 which is recess mounted along one side of the receptacle 22 and is further spaced from the respective top and bottom walls of the receptacle 22 to accommodate the flanges 30, 32.

A circular locking cam 86 is pivotally mounted to the rear wall of the housing 84 by a pivot pin 88. The locking cam 86 further includes a circumferential lobe 90 as illustrated in FIG. 4 and a pair of locking bars 92, 94 each of which is pinned at one end to the cam 86. A distal end of each of the locking bars is extendable through a respective top 96 and bottom 98 wall opening of the housing. A spring 100 affixed to a side wall of the housing engages a lower locking bar for urging the locking cam 86 in a clockwise direction wherein the locking bars are in an open or retracted position. The cam lobe 90 will be resiliently urged into contact with a limit stop 102. When the locking cam 86 is rotated in a counterclockwise direction as indicated by the arrows in FIG. 4 and broken line illustration, each of the locking bars 92, 94 will then be extendable through the respective apertures 96, 98 in the top and bottom walls of the housing and through the locking slots 34, 36 in the respective door flange 30, 32. When the locking cam 86 is in this locked position, the cam lobe 90 contacts limit stop 104.

With regard to the activation of the locking cam 86, reference is made to the rectangular keyway 76. The keyway 76 is formed within a bracket 106 affixed to the cam 86 and is adapted for receiving the tail member 58 of the key plug 52. It should be apparent that use of the operating key 56 and rotation of the key plug 52 will be effective for rotating the locking cam 86 which will be selectively held in a locked position when the keeper bar 70 snaps into channel 80. The key 56 can then be removed.

Thus, it will be seen that there is provided a security lock box with a removable key plug which achieves the various objects of the invention and which is well adapted to meet the conditions of practical use.

Since other possible embodiments might be made of the present invention and various changes might be made in the exemplary embodiment set forth, it is to be understood that all material set forth or shown in the accompanying drawings is to be interpreted in an illustrative sense and not in a limiting sense.

Having thus described the invention, there is claimed as new and desired to be secured by Letters Patent:

1. A security system utilizing a removable key plug comprising receptacle means for the safekeeping of valuables, said receptacle means including an access opening, closure means positionable within the access opening, a latching mechanism for securing the closure means in a locked position within the access opening, locking means mounted to said closure means, said locking means including a cylinder housing, at least one key plug, said key plug being removably accommodatable within the cylinder housing for actuating the latching mechanism, said key plug further including retainer means for simultaneously engaging the cylinder housing when the latching mechanism is actuated to a locked position and for disengaging the key plug for withdrawal from the cylinder housing when the latching mechanism is in an open position.

2. A security system as claimed in claim 1 wherein the cylinder housing is adapted for accepting a plurality of interchangeable key plugs with each key plug having a respective operating key.

3. A security system as claimed in claim 1 wherein the retainer means includes a tail means extending exteriorly of the cylinder housing, said tail means further being registrable with the latching mechanism.

4. A security system as claimed in claim 3 wherein the tail means includes a fin member, said cylinder housing defining a complementary groove positioned interiorly of the housing for interfitting engagement with the fin member during rotational displacement of the key plug to provide additional securement for retainment of the key plug within the cylinder housing.

5. A security system as claimed in claim 1 wherein the latching mechanism is mounted along a margin of the access opening and includes a pivotally mounted cam, at least one lock bar pinned at one end to the cam, the other end of said lock bar being engageable with the closure means during rotational displacement of the cam.

6. A security system as claimed in claim 5 wherein the latching mechanism includes a keyway for accepting a tail means when the closure means is within the access opening, said keyway being linked to the cam whereby rotation of the key plug displaces the lock bars.

7. A security system as claimed in claim 6 wherein the closure means includes a flange member projecting normally from an edge of said closure means, said flange member being provided with a locking slot, said locking slot being adapted for receiving the other end of said lock bar.

8. A security system as claimed in claim 7 further including a hinge return extending along a vertical edge of the closure means, said access opening defining a confronting inturned lip along a margin of said opening, said hinge return being adapted for cooperative interlocking with the inturned lip when the closure means is within the access opening.

9. A security system as claimed in claim 7 wherein the closure means is hingedly mounted to the receptacle means, said mounting including a hinge pin, said pin extending through a pair of aligned apertures in a respective upper and lower flange member, the opposite ends of said hinge pin being secured in a respective top and bottom wall of the receptacle.

10. A security system as claimed in claim 1 wherein the cylinder housing includes a cylindrical passageway adapted for slidably accommodating the key plug for longitudinal and rotational movement.

11. A security system as claimed in claim 10 wherein the key plug is provided with key retention means for preventing removal of an operating key, said key retention means including a spring biased keeper bar, said keeper bar being adapted for engaging the key when the keeper bar is urged within the key plug by a confronting surface of the cylindrical passageway.

12. A security system as claimed in claim 11 further including a longitudinal channel within the cylindrical passageway for selective registration with the keeper bar, whereby the key can be withdrawn from the key plug.

13. A security system as claimed in claim 12 wherein the longitudinal channel is registrable with the keeper bar when the tail means is lockingly engaged within the cylinder housing.

14. A security system as claimed in claim 13 wherein the passageway contains a portal notch, said portal notch being adapted for depressing the keeper bar during insertion of the key plug, said keeper bar further being releasable within said channel upon rotation of the key plug and actuation of the latching mechanism to a locked position.

15. A security lock box for the safekeeping of valuables including a lock cylinder in combination with interchangeable key plugs and comprising a receptacle, said receptacle having an access opening, a door for closing said access opening, latching means for securing the door in a locked position, said door including a cylinder housing, said cylinder housing defining a passageway therethrough, said cylinder housing further being adapted for receiving a plurality of removable key plugs, said key plugs being selectively insertable in the passageway at one end of the housing, said housing further defining a shoulder segment at the other end, said key plug including a tail member, said tail member being registrable with and adapted for actuating the latching means when the door is within the access opening, with said tail member being simultaneously engageable with the shoulder segment for preventing withdrawal of the key plug when the latching mechanism is actuated to a locked position and disengageable from the shoulder segment when the latching mechanism is in an opening position.

* * * * *